United States Patent [19]

Engen

[11] 4,125,219

[45] Nov. 14, 1978

[54] BAG FOR VACUUM CLEANERS

[76] Inventor: Anders Engen, Dragonveien 40, 1362 Billingstad, Norway

[21] Appl. No.: 816,013

[22] Filed: Jul. 15, 1977

[30] Foreign Application Priority Data

Jul. 16, 1976 [NO] Norway ..... 762495

[51] Int. Cl.[2] ..... B65D 31/12

[52] U.S. Cl. ..... 229/53; 55/382; 55/486; 55/524; 55/DIG. 2

[58] Field of Search ..... 55/381, 382, 361, 486, 55/524, DIG. 2; 229/53

[56] References Cited

U.S. PATENT DOCUMENTS

| | | | |
|---|---|---|---|
| 754,053 | 3/1904 | Derham | 55/382 |
| 1,581,450 | 4/1926 | Kampf | 229/53 |
| 1,821,824 | 9/1931 | Woodward | 55/486 |
| 1,897,976 | 2/1933 | Birkholz | 55/522 |
| 2,188,428 | 1/1940 | Evans | 55/279 |
| 2,324,231 | 7/1943 | Österdahl | 55/382 |
| 2,813,596 | 11/1957 | Voigtman et al. | 55/382 |
| 2,867,183 | 1/1959 | Klasing | 55/361 |
| 3,058,647 | 10/1962 | Reiselt | 229/53 |
| 3,774,375 | 11/1973 | Smith | 55/382 |

FOREIGN PATENT DOCUMENTS

| | | |
|---|---|---|
| 8,370 | 3/1902 | Austria. |
| 7,118,640 | 5/1971 | Fed. Rep. of Germany. |
| 704,513 | 2/1941 | Fed. Rep. of Germany. |
| 420,517 | 3/1967 | Switzerland. |
| 5,471 of | 1915 | United Kingdom. |
| 549,809 | 12/1942 | United Kingdom. |

*Primary Examiner*—Stephen P. Garbe
*Attorney, Agent, or Firm*—Scully, Scott, Murphy & Presser

[57] ABSTRACT

A disposable dust-collecting bag consisting of a mat which has been folded once in its transverse direction and consists of several layers of separate strips of non-woven fibrous web laid in parallel relationship in each layer and so that the strips of non-woven fibrous web in one layer are laterally displaced with regard to the strips of non-woven fibrous web in the adjacent layer or layers.

6 Claims, 5 Drawing Figures

BAG FOR VACUUM CLEANERS

BACKGROUND OF THE INVENTION

1. Field of the invention

This invention relates to bags or sacks for vacuum cleaners, especially of the type used for large vacuum cleaners or for vacuum cleaners for the industry.

2. Description of the prior art

When dust is sucked into a vacuum cleaner of conventional type the dust-laden air passes into the vacuum cleaner and through a dust-collecting bag or sack, and the cleaned air passes through the walls of the bag or the sack and out of the vacuum cleaner. It is a disadvantage of conventional dust-collecting bags or sacks that their walls are rapidly becoming clogged by dust and that the pressure drop across the walls of the bag or the sack soon becomes so high that the suction effect rapidly decreases and the bag or the sack must be replaced. However, only a small proportion of the volume of the bag or the sack will then usually be filled with dust, and, accordingly, the conventional dust-collecting bags or sacks are poorly utilized with regard to their total volume.

Previously, permanent dust-collecting bags of cloth were used in the conventional household vacuum cleaners. When the user noticed that the suction effect became too poor, the suction head had to be removed from the vacuum cleaner, the bag had to be loosened, the dust had to be shaken out of the bag and the bag had to be thoroughly shaken in order to remove the absorbed and obstructing dust in the bag walls. This was an uncomfortable and laborious operation. In vacuum cleaners of the more modern type disposable insert bags of porous paper of special grades are used which are thrown away when the bag walls have become so clogged by dust that the suction effect ceases or is strongly reduced.

There is a further problem connected with vacuum cleaners used in the industry that the dust sucked in may be very dense and the necessary suction pressures so high that the dust-collecting paper bags used may easily tear apart due to the heavy strain to which the bags are exposed. Because a relatively unhindered passage of air through the walls of the dust-collecting bags is necessary in order to obtain a reasonable service life and a reasonable amount of dust sucked into the bag before the bag has to be replaced, such dust-collecting bags may necessarily not consist of strong paper of low porosity or of several layers of paper because the pressure drop across a such bag would then rapidly increase leading to reduced suction effect. Also with the dust-collecting bags used in vacuum cleaners for the industry the volume filled with dust will be relatively low compared with the total internal volume of the bag before the suction effect has been reduced so strongly that the bag must be replaced.

Accordingly, there is great demand for an improved dust-collecting bag for use in vacuum cleaners, especially in vacuum cleaners for the industry, which will not be clogged by dust before a substantial portion of the internal volume of the bag has become filled with dust, which has a sufficient mechanical strength to be able to withstand handling while being inserted into and removed from the vacuum cleaners and to contain large amounts by weight of dust with regard to the internal volume of the bag without tearing thereof, and which during use and until it has been essentially filled with dust does not cause the pressure drop across its walls to increase substantially compared with the pressure drop when starting the suction of the dust.

SUMMARY OF THE INVENTION

This objective is obtained by means of the disposable dust-collecting bag according to the invention for use in vacuum cleaners, which at its upper part is provided with an opening for suction of dust-laden air into the bag which is characterized therein that it consists of a mat which has been folded once in its transverse direction and consists of several layers of separate strips of non-woven fibrous web laid in parallel relationship in each layer and so that the strips of non-woven fibrous web in one layer are laterally displaced with regard to the strips of non-woven fibrous web in the adjacent layer or layers and/or the separate parallel strips of non-woven fibrous web in each layer are laid in a successively overlapping relationship, the strips of non-woven fibrous web having their longitudinal direction which is determined by the direction of the strips of non-woven fibrous web, in the same direction as the height of the bag which on its inner and outer face is provided with a coherent layer of non-woven fibrous web, and the bag walls being provided with separate transverse strips of an adhesive which penetrates the outer coherent layer of non-woven fibrous web, the intermediate layers of strips of non-woven fibrous web and the coherent layer of non-woven fibrous web inside the bag and bonds the layers to one another, whereby the bag is built up of transverse and parallel dust-collecting sections.

In order to further increase the dust-collecting effect and the penetrability for air through the bag the bag may along its side edges be folded inwards and provided with a seam along the side edges so that portions of strips of non-woven fibrous web will extend a short distance into the bag along the side edges thereof.

The bag according to the invention is at its upper edge provided with a seam, and an opening for sucking dust-laden air into the bag is provided a short distance down from the upper seam of the bag in order to ensure that above the suction opening there is available a bag section which during the whole period when air is sucked into the bag offers little resistance to passage therethrough of air from which dust has been removed. This opening is stamped or cut out near the one end of a mat of suitable length for the bag to be produced, and about the opening an adhesive is applied which penetrates the layers of non-woven fibrous web and is used for adhesively securing to the bag an apertured rigid plate with an apertured flexible gasket, e.g. of rubber or plastics, inserted into the aperture in the rigid plate which e.g. may consist of two plates of stiff cardboard, the gasket being securely fixed between the two plates. In order to facilitate placement of the dust-collecting bag in the vacuum cleaner preferably the apertured plate is not adhesively secured to the bag along a portion of the plate laterally of its aperture. It is thereby possible to grip between the plate and the bag so that the bag may be lifted by hand and easily inserted into the vacuum cleaner and connected to the end of the suction pipe or tube leading into the vacuum cleaner.

DETAILED DESCRIPTION OF THE INVENTION

When dust-laden air is sucked into the bag with the bag vertically arranged in the vacuum cleaner, the air will flow down along one sidewall of the bag towards the bottom of the bag and then turn up along the opposite sidewall of the bag and seak to get out through the upper part of the bag. During this flow of air in the bag the dust is deposited from the bottom of the bag and upwards. Some air will also penetrate through the dust-collecting sections forming the sidewalls of the bag, from the bottom of the bag and upwards, and due to the particular "lamellar" construction of the bag according to the invention the air will meet relatively little resistance to passage through the various dust-collecting sections of the bag until the sections have been substantially completely filled with dust. It has been found that the bag becomes uniformly filled with dust from the bottom and up to near the suction opening and that when using the bag for suction of even the most difficultly manageable dust, like cement dust, the bag offers little resistance to passage therethrough of the air from which dust has been removed, so that the bag may be filled with dust substantially up to the suction opening of the bag. The filtering effect which is obtained by means of the particular construction of the vacuum cleaner bag according to the invention is so good that even after the bag has been substantially completely filled up to its suction opening with a strongly soiling dust, the bag is still essentially clean at its outer surface and may, accordingly, be removed and replaced with a new bag without the clothes of the cleaning operative being soiled.

In order to facilitate suspending the bag in the vacuum cleaner the bag may at its top be provided with two or more bands or straps securedly attached to the top of the bag and which may consist of several layers of the same non-woven fibrous web material which is used for making the bag itself. These bands may be used for suspending the bag in the vacuum cleaner by means of a suitable suspending device on the vacuum cleaner.

Figure 1:
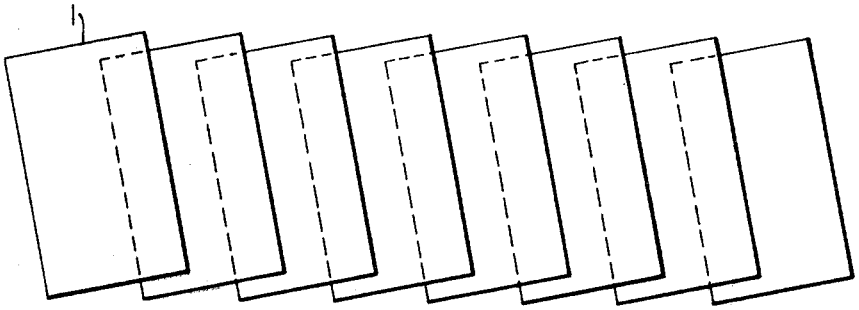
Figure 2:
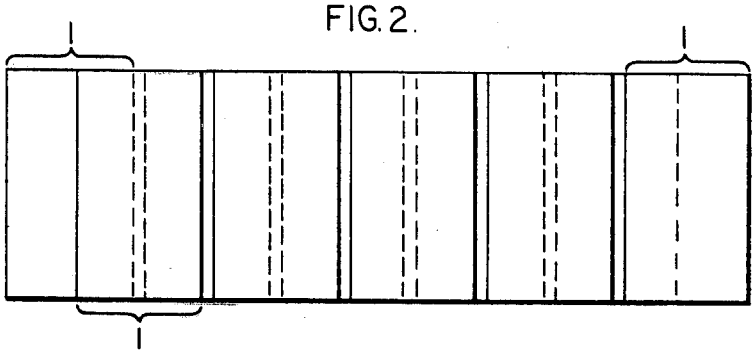
Figure 3:
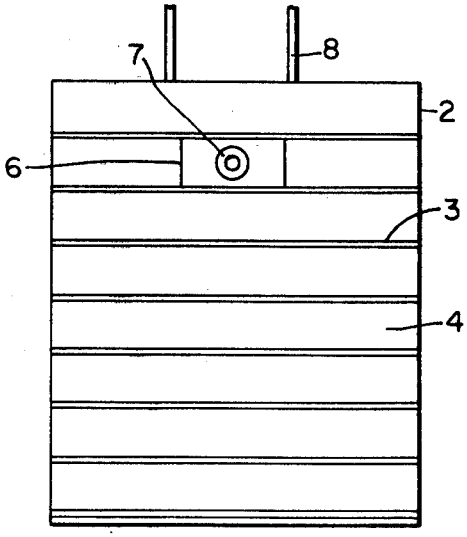
Figure 4:
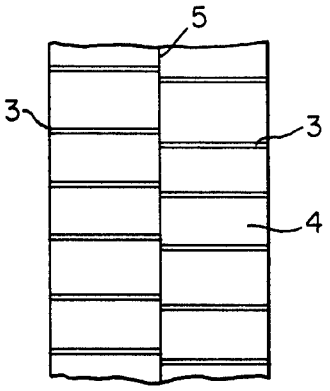
Figure 5:
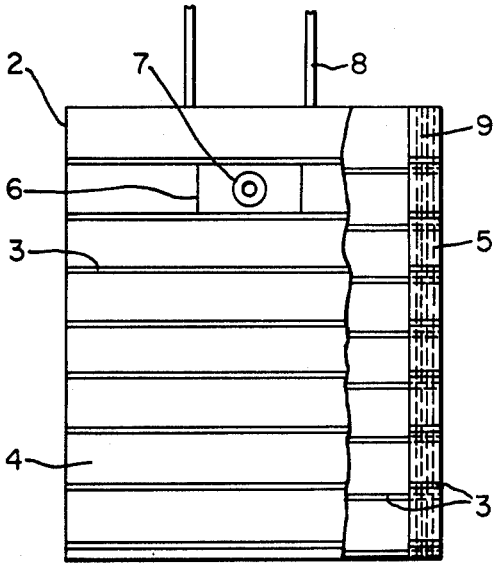

The invention will be more detailedly described below with reference to the drawings, of which FIG. 1 shows a layer of parallel strips of non-woven fibrous web laid in successively overlapping relationship, FIG. 2 shows a horizontal view of two layers of parallel and abutting strips of non-woven fibrous web so laid that the strips of non-woven fibrous web in the upper layer overlap the joints between the respective strips of non-woven fibrous web in the lower layer, FIG. 3 shows a front elevation of a bag according to the invention with the suction opening of the bag, FIG. 4 shows a section of a side elevation of the bag according to the invention, and FIG. 5 shows the bag according to FIG. 3 with its front wall partly removed.

FIGS. 1 and 2 are presented to show the manner in which separate strips of non-woven fibrous web may be placed relative to each other to form a mat which may be utilized in the construction of a dust-collecting bag such as is shown in FIGS. 3, 4 and 5. FIGS. 1 and 2 are not drawn to scale in reference to FIGS. 3, 4 and 5, and if, for example, the dust-collecting bag shown in FIG. 3 were assembled from strips laid as shown in either FIGS. 1 or 2, the length of those strips would be approximately twice the height of the bag shown in FIG. 3.

From FIG. 1 and 2 it appears how the strips 1 of non-woven fibrous web in the separate layers may be placed with regard to one another, and the number of such layers for building up the mat for the bag according to the invention will depend upon the desired filtering effect for the dust-laden air which is sucked into the bag, and upon the desired mechanical strength of the bag. A suitable number of layers for constructing a bag for industrial uses is 14, and on each face of the mat of layers of strips of non-woven fibrous web there is used a coherent layer of non-woven fibrous web which covers the two faces of the mat.

On FIG. 3 a bag 2 is shown with dust-collecting sections or pockets 4, the bag being formed by folding the mat of strips of fibrous web once in its transverse direction subsequent to application to the mat of penetrating strips 3 of adhesive across the mat and thereby also across the longitudinal direction of the strips of non-woven fibrous web. In the embodiment shown in FIG. 3 the longitudinal direction of the non-woven fibrous web, which is determined by the direction of the strips of non-woven fibrous web, is in a vertical direction. The strips in each layer of the mat extend from the top of one side of the bag 2 to the bottom, at which the strips are folded along a direction transverse to their length, and then back up to the top of the other side of the bag. However, before folding the mat an adhesive is also applied to a restricted area of the mat near one end thereof so that the adhesive penetrates through the thickness of the mat. The suction opening near this end of the mat is then stamped or cut out from the mat so that the opening is surrounded by a rim of the previously applied adhesive, and a rigid plate 6 with a central aperture wherein a flexible gasket 7 with a central opening is inserted, is securely attached to the mat by means of the adhesive surrounding the suction opening. The mat provided with the rigid plate is then folded in its transverse direction so that the rigid plate faces inwards, and the folded mat is then provided with a seam along its side edges. The seam is preferably provided a short distance inward from the side edges of the folded mat, and after having provided the mat with the seam along its side edges, the mat which has now been converted into a bag with its top open, is turned inside out so that the rigid plate with the suction opening is again facing outwards. The bag is then provided with an upper transverse seam which, if desired, may also be applied to simultaneously attach the suspending straps 8 to the bag.

On FIG. 4 is shown a seam 5 along one side of the folded mat, and to the right on FIG. 5 is shown how a portion 9 of the mat extends a distance into the finished bag 2, this portion extending inwards consisting of longitudinal edge portions of four coherent covering layers of non-woven fibrous web with longitudinal edge portions of strips of non-woven fibrous web between each two of the covering layers.

As fibrous material for making the present bag strips of non-woven fibrous web of regenerated cellulose or a similar material are used wherein the fibers are kept in place in the fibrous web by means of an added binder. Such fibrous webs are produced in large volumes in the non-woven industry.

The adhesive used for applying the strips of adhesive may be any adhesive which is capable of penetrating through all layers of fibrous web because the purpose of the adhesive only is to locally bond the layers of strips of fibrous web and the covering layers to one another and to form transverse dust-collecting sections between the strips of adhesive. When superposing several such layers the strips of adhesive bond the lower face of one layer to the upper face of the next underlying layer etc. In order to bond all the layers to one another the strips of adhesive must penetrate through all layers. This makes it possible to build up a thick mat of layers of non-woven fibrous web which as desired may be weakly or strongly bonded to one another dependent upon the adhesive used, the amount of adhesive used and the number of strips of adhesive applied. Acrylic adhesives in the form of emulsions are particularly well suited for applying the strips of adhesive to the upper face of the mat. After application the strips of adhesive will penetrate through all the layers and the adhesive is subsequently set by application of heat and pressure to the strips of adhesive.

The present bags may be produced in any length, width and thickness desired, and the bags have very low weight and high mechanical strength and may easily be handled for insertion into and removal from vacuum cleaners. Further, as the bags have a very high dust-collecting capacity compared with known bags for vacuum cleaners with the same internal volume and because the pressure drop across the walls of the bags only increases relatively little as the bags become filled with dust, the bags are also very economical in use. As an example it may be mentioned that a bag having a height of 78 cm, a width of 57 cm and consisting of a mat folded as described above and consisting of 14 layers of strips of non-woven fibrous web with a coherent covering layer of non-woven fibrous web on each face of the mat and having eight transverse strips of adhesive applied to each wall of the bag so as to make the bag built up of 17 transverse sections or pockets separated from one another by means of strips of adhesive, became essentially filled from the bottom and up to its suction opening with about 50 kg cement when sucking cement during 45 seconds from an area of 5 $m^2$ using a suction which to begin with was 2200 mm $H_2O$ and after 45 seconds had decreased to 1500 mm $H_2O$. After use the bag was still clean on the outside and could without difficulties be removed from the vacuum cleaner without soiling the clothes of the cleaning operative. A section which was cut through the bag after use showed that not only had the dust been collected inside the bag itself but a significant amount of dust and also been collected in each transverse section due to the easy access of the dust-laden air into the separate sections because of the lamellar construction of the bag with layers of parallel strips of non-woven fibrous web.

It has been calculated that the bag described above will offer a filtering area which is about 25 $m^2$ larger than the filtering area offered by conventional paper bags of the same dimension for vacuum cleaners.

Moreover, the present bag is capable of withstanding all types of solvents which will not dissolve the binder, e.g. styrene- or acrylic -based binders, in the fibrous web, and the bag may without risk of failure be alternatingly used for wet- and dry- suction in contrast to the conventional paper bags which cannot be used for wet suction.

The present bag will neither be damaged by sharp particles sucked into the bag. This has been shown by means of tests where two bear bottles were crushed to chips of suitable size, whereupon the chips were mixed with one standard package of 1 inch nails for asphalted roofing board and with 50 kg cement. This mixture was completely sucked into the sack without the sack tearing apart.

Sucking of foaming liquids presents problems at the suction side with conventional vacuum cleaners. Subpressure combined with turbulence directly below the suction opening will whip the foam into a large volume compared with the volume of the liquid sucked into the bag. Foam will then be sucked into the metal containers which are presently used for this purpose, and pass directly through fans and openings of the suction machine whereas due to its low density the foam will not be able to drive the conventionally used floats to their closing position. This problem may be avoided by the use of the present bag by impregnating the bag with an anti-foaming agent in an amount dependent upon the volume of the tank, whereby the foam formed will be disintegrated as it passes upwards in the bag.

Obnoxious and unhygienic materials may also be sucked up using the present bag which e.g. by suction of sludge, like sewage, will keep the solids in the bag while the water will filter out through the bag.

The present bag for vacuum cleaners is also of great importance for suction of production wastes in a number of industries. These wastes may be sucked into a clean bag without risk of the bag tearing apart.

The strips of non-woven fibrous web which are used for making the present bag may be of strongly varying width, e.g. from 2 to 30 cm. Broad strips of non-woven fibrous web will give separate layers of a more stable shape and thereby a mat of layers of non-woven fibrous web which is of a more stable shape and may be more easily handled, whereas narrow strips will give an increased lamellar effect and thereby make it easier for the dust-laden air to penetrate into the sections of the bag so that the rate of collection of the dust in these sections will increase. The width of the strips of non-woven fibrous web used may depend among other things upon the available width when using strips of non-woven fibrous web obtained by edge trimming of large rolls of fibrous web as conventionally produced in the non-woven industry. Such trimmed off strips have hitherto presented a significant waste problem and may now be used for producing the present bag for vacuum cleaners.

Non-woven webs based on regenerated cellulose fibers (rayon fibers) are currently produced in various grades as regards their area weight. In general, the non-woven webs useful for the bag according to the invention will have an area weight varying from 15 $g/m^2$ to 100 $g/m^2$ or higher. The number of layers of strips of non-woven fibrous web in the bag walls may vary depending upon the area weight of the non-woven fibrous web used, and in general the number of layers decreases with increasing area weight of the fibrous web in order to avoid an unnecessarily thick bag or an unnecessarily high pressure drop across the bag walls in order to obtain the desired filtering effect. It is generally preferred to use grades of non-woven fibrous webs within the lower part of the area weight range stated above, for reasons of obtaining an improved lamellar and filtering effect for the same weight of the bag as when using fewer layers of strips of a more heavy grade of non-woven fibrous web.

In non-woven fibrous webs (rayon webs) the fibers are rather randomly oriented with an individual fiber length of up to about 50 mm. In paper webs the average fiber length is usually 2–3 mm only. For the bag described above with its walls consisting of 14 layers of strips of non-woven fibrous web and with a coherent covering layer of non-woven fibrous web on the outer face and on the inner face of the bag respectively, a non-woven web based on regenerated cellulose fibers and having an area weight of 16 g/m$^2$ was used.

The particular method described above for making the disposable dust-collecting bag according to the invention is, of course, not restricting for how the bag may be produced. Thus, after the mat of layers of non-woven fibrous web has been made the transverse and penetrating strips of adhesive and the adhesive for attaching the rigid plate to the mat have been applied, the suction opening has been stamped out and the rigid plate has been attached about the suction opening, the mat may simply be folded once in its transverse direction with the rigid plate facing outwards, and a seam may be applied along the sides and the top of the folded mat a short distance, e.g. 0.5 cm, inward from the side edges and the top of the folded mat.

The suction opening at the upper part of the dust-collecting bag according to the invention does not have to be provided through one of the side walls of the bag but may simply be provided by applying a separate seam to the upper part of the bag from each of its side edges and inward towards the longitudinal center line of the bag to a point intermediate the side edge and the center line, and then turning up to the upper edge of the bag. In this manner there will be formed a suction opening into the bag through the upper edge of the bag and with a smaller diameter than the diameter of the rest of the bag. The thus restricted opening into the bag will have a length which will be suitable for attaching the bag to the end of the suction tube. Those portions of the folded mat which will then remain at each side of the suction opening and between the upper edge of the bag and the upper seam from the side edge of the bag and inwards, may be cut away so that the bag at its upper end will be provided with a protruding integral portion through which the suction opening leads into the bag.

I claim:

1. A disposable dust-collecting bag for use in a vacuum cleaner, which at its upper part is provided with an opening for suction of dust-laden air into the bag which has walls comprising several layers of non-woven cellulosic material with an outer wrapper of non-woven cellulosic material, the layers of non-woven cellulosic material and the outer wrapper of non-woven cellulosic material being joined together by means of separate lines of an adhesive extending transversely of the bag, characterized in that bag walls have an inner and outer coherent layer of non-woven fibrous web respectively and between the inner and outer layer have several layers of separate strips (1) of non-woven fibrous web laid in parallel relationship in each layer and so that the strips of non-woven fibrous web in one layer are laterally displaced with regard to the strips of non-woven fibrous web in the adjacent layer in an overlapping relationship, the strips of non-woven fibrous web extending from the top of one bag wall around the bottom of the bag and up to the top of the other bag wall, and the separate transverse lines (3) of an adhesive penetrating the outer layer of non-woven fibrous web, the intermediate layers of strips of non-woven fibrous web and the layer of non-woven fibrous web inside the bag, whereby the bag walls are built up of transverse and parallel dust-collecting sections (4).

2. A bag as claimed in claim 1, characterized in that it has been folded inwards along its side edges and is provided with a seam (5) along its side edges so that the strips of non-woven fibrous web extend a short distance (9) into the bag (2) along its side edges.

3. A bag as claimed in claim 1, characterized in that about its suction opening the bag is provided with a penetrating adhesive and with an adhesively fixed apertured rigid plate (6) in which a centrally apertured flexible gasket (7) is inserted and attached to the rigid plate which along its outer edges in the lateral direction of the bag (2) is not adhesively attached to the bag.

4. A bag as claimed in claim 1, characterized in that at its upper part the bag is provided with two or more attached straps (8) for suspending the bag (2) in the vacuum cleaner.

5. A bag as claimed in claim 1, characterized in that its suction opening has been stamped out in the next to the uppermost of the sections (4) formed by the penetrating strips (3) of adhesive in one of the sidewalls of the bag (2).

6. A bag as claimed in claim 1 for suction of foaming liquids, characterized in that the fibrous web is impregnated with an antifoaming agent.

* * * * *